US006779361B1

(12) United States Patent
Skare et al.

(10) Patent No.: US 6,779,361 B1
(45) Date of Patent: Aug. 24, 2004

(54) CRYOGENIC AIR SEPARATION SYSTEM WITH ENHANCED LIQUID CAPACITY

(75) Inventors: Todd Alan Skare, Elma, NY (US); Sean Durbin, Shanghai (CN); Joseph Alfred Weber, Cheektowaga, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/669,266

(22) Filed: Sep. 25, 2003

(51) Int. Cl.[7] ..... F25J 3/04
(52) U.S. Cl. ..... 62/643
(58) Field of Search ..... 62/606, 617, 640, 62/643

(56) References Cited

U.S. PATENT DOCUMENTS 4,778,497 A 10/1988 Hanson et al. ..... 62/11
4,894,076 A 1/1990 Dobracki et al. ..... 62/9
5,231,835 A 8/1993 Beddome et al. ..... 62/9
5,678,425 A 10/1997 Agrawal et al. ..... 62/646
5,758,515 A 6/1998 Howard ..... 62/646
5,799,505 A 9/1998 Bonaquist et al. ..... 62/613
5,802,873 A 9/1998 Howard ..... 62/646
5,836,173 A 11/1998 Lynch et al. ..... 62/613
6,543,253 B1 4/2003 Schaub et al. ..... 62/643

*Primary Examiner*—Cheryl J. Tyler
*Assistant Examiner*—Malik N. Drake
(74) *Attorney, Agent, or Firm*—Stanley Ktorides

(57) ABSTRACT

A cryogenic air separation system having enhanced liquid production capacity wherein a feed air stream bypasses the primary heat exchanger and is processed through cooling and warming passes of a feed air liquefier to produce liquid feed air for introduction into the cryogenic air separation plant.

10 Claims, 2 Drawing Sheets

CRYOGENIC AIR SEPARATION SYSTEM WITH ENHANCED LIQUID CAPACITY

TECHNICAL FIELD

This invention relates generally to cryogenic air separation and is particularly useful for enhancing the ability of a cryogenic air separation system to produce liquid product.

BACKGROUND ART

A cryogenic air separation plant has fixed refrigeration output and liquid product rates based on existing equipment. Increases in liquid production are frequently required beyond existing system capabilities. Such increases may be achieved by reconfiguring the existing system by using the main heat exchanger to supply the requisite additional refrigeration. However, such a reconfiguration to existing equipment is difficult and costly to implement.

Accordingly it is an object of this invention to provide a cryogenic air separation system having enhanced liquid capacity wherein the requisite additional refrigeration is provided to the cryogenic air separation plant without involving the main heat exchanger.

SUMMARY OF THE INVENTION

The above and other objects, which will become apparent to those skilled in the art upon a reading of this disclosure, are attained by the present invention, one aspect of which is:

A method for carrying out cryogenic air separation comprising:

(A) compressing feed air and passing a first portion of the compressed feed air into a cryogenic air separation plant;

(B) further compressing a second portion of the compressed feed air to produce further compressed feed air, turboexpanding a first part of the further compressed feed air and warming the turboexpanded first part of the further compressed feed air by indirect heat exchange with a second part of the further compressed feed air to condense said second part of the further compressed feed air;

(C) passing the condensed second part of the further compressed feed air into the cryogenic air separation plant; and (D) producing by cryogenic rectification within the cryogenic air separation plant at least one of product oxygen, product nitrogen and product argon.

Another aspect of the invention is:

Apparatus for carrying out cryogenic air separation comprising:

(A) a primary compressor, a booster compressor, a cryogenic air separation plant, means for passing feed air to the primary compressor, means for passing feed air from the primary compressor to the cryogenic air separation plant, and means for passing feed air from the primary compressor to the booster compressor;

(B) a turboexpander, a heat exchanger having a cooling pass and a warming pass, means for passing feed air from the booster compressor to the turboexpander and from the turboexpander to the warming pass, and means for passing feed air from the booster compressor to the cooling pass;

(C) means for passing feed air from the cooling pass to the cryogenic air separation plant; and (D) means for recovering at least one of product oxygen, product nitrogen and product argon from the cryogenic air separation plant.

As used herein the term "feed air" means a mixture comprising primarily oxygen, nitrogen and argon, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*. The term "double column" is used to mean a higher pressure column having its upper end in heat exchange relation with the lower end of a lower pressure column.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the terms "turboexpansion" and "turboexpander" mean respectively method and apparatus for the flow of high pressure gas through a turbine to reduce the pressure and the temperature of the gas, thereby generating refrigeration.

As used herein the term "compressor" means a machine that increases the pressure of a gas by the application of work.

As used herein the term "cryogenic air separation plant" means a facility for fractionally distilling feed air, comprising one or more columns and the piping, valving and heat exchange equipment attendant thereto.

As used herein the term "booster compressor" means a compressor which provides additional compression for purposes of attaining higher air pressures required for the condensation of feed air.

As used herein the term "product oxygen" means a fluid having an oxygen concentration of at least 90 mole percent.

As used herein the term "product nitrogen" means a fluid having a nitrogen concentration of at least 99 mole percent.

As used herein the term "product argon" means a fluid having an argon concentration of at least 97 mole percent.

DETAILED DESCRIPTION

The invention is a system for enhancing the liquid capacity of a cryogenic air separation plant by integrating in a defined manner a feed air liquefier with the plant without employing the main heat exchanger of the plant in the integration. In this way the feed air liquefier bypasses the main heat exchanger and thus can readily provide the requisite additional refrigeration for the enhanced liquid capacity without reconfiguring or disrupting the existing plant arrangement. The invention will be described in greater detail with reference to the Drawings.

Figure 1:
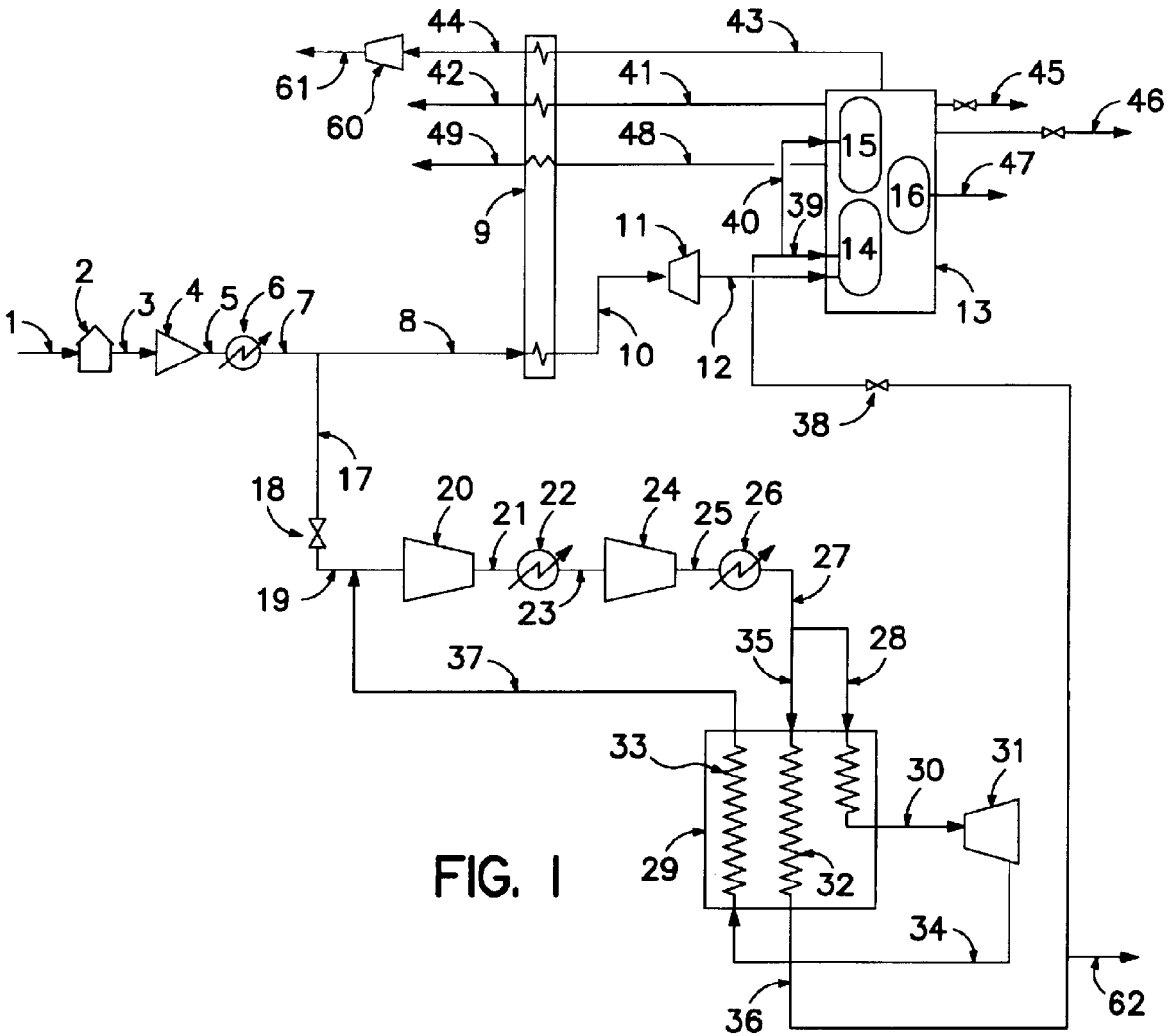
FIG. 1 is a simplified schematic representation of one preferred embodiment of the enhanced liquid capacity cryogenic air separation system of this invention.

Referring now to FIG. 1, feed air 1 is cleaned of high boiling impurities such as water vapor, carbon dioxide and hydrocarbons in purification system 2, and passed in stream 3 to primary compressor 4 wherein it is compressed to a pressure generally within the range of from 30 to 300 pounds per square inch absolute (psia). Resulting compressed feed air 5 is cooled of the heat of compression in cooler 6 to form feed air stream 7. A first portion 8 of the compressed feed air is passed to primary heat exchanger 9 wherein it is cooled by indirect heat exchange with return streams such as gaseous product or waste streams. Resulting cooled feed air first portion 10 is turboexpanded by passage through turboexpander 11 and passed as stream 12 into cryogenic air separation plant 13. Any cryogenic air separation plant may be used in the practice of this invention including single column plants, double column plants and dual column plants. The cryogenic air separation plant illustrated in very simplified form in FIG. 1 is a double column plant having a higher pressure column 14 and a lower pressure column 15, and also having an argon sidearm column 16. Those skilled in the art are familiar with these terms and with the operation of such cryogenic air separation plants.

A second portion 17 of the feed air is used in the feed air liquefier which is employed to provide additional refrigeration to the cryogenic air separation plant. Second portion 17 generally comprises from 5 to 30 percent, preferably from 10 to 20 percent, of the compressed feed air, dictated by column flooding limitations, turbine equipment constraints, and plant configuration. It is an important aspect of this invention that the second portion does not traverse the primary heat exchanger either partially or totally. In this way the auxiliary feed air liquefier, which provides the additional refrigeration to the cryogenic air separation plant, operates independently of the original plant and does not disrupt the original plant design.

Referring back now to FIG. 1, second feed air portion 17 is passed through valve 18 and as stream 19 to recycle compressor 20 wherein it is compressed to a pressure generally within the range of from 200 to 600 psia. Resulting stream 21 is cooled of the heat of compression in cooler 22 and passed in stream 23 to booster compressor 24 wherein it is further compressed so as to be at a pressure generally within the range of from 300 to 1100 psia. The further compressed feed air is withdrawn from booster compressor 24 in stream 25 and cooled of heat of compression in cooler 26 to form further compressed feed air stream 27. A first part 28 of the further compressed feed air, generally comprising from about 70 to 95 percent of the further compressed feed air, is cooled by partial traverse of heat exchanger 29 and then passed in stream 30 to turboexpander 31 wherein it is turboexpanded to a pressure generally within the range of from 20 to 110 psia to generate refrigeration.

Heat exchanger 29, which may also be termed a feed air condenser, has a cooling pass 32 and a warming pass 33. The cooling pass is the passageway wherein feed air is condensed, and the warming pass is the passageway wherein turboexpanded feed air is warmed. Heat exchanger 29 is separate from the primary heat exchanger, i.e. no gaseous product or waste streams from the cryogenic air separation plant traverse heat exchanger 29. The refrigeration-bearing turboexpanded first part is withdrawn from turboexpander 31 in stream 34 and passed into warming pass 33 of heat exchanger or feed air condenser 29. A second part 35 of the further compressed feed air, generally comprising from about 5 to 30 percent of the further compressed feed air, is passed into cooling pass 32 of heat exchanger 29 wherein it is condensed by indirect heat exchange with the warming feed air passing through warming pass 33. The resulting condensed feed air is withdrawn from cooling pass 32 of heat exchanger 29 in stream 36, and the resulting warmed feed air is withdrawn from warming pass 33 of heat exchanger 29 in stream 37. Preferably, as shown in FIG. 1, stream 37 is passed into stream 19 for recycle to the booster compressor.

The condensed second part of the further compressed feed air withdrawn from heat exchanger 29 in stream 36 is passed to the cryogenic air separation plant and into at least one column of the cryogenic air separation plant. When a double column plant is employed the condensed feed air may be passed into the higher pressure column, the lower pressure column or into both of these columns. In the embodiment illustrated in FIG. 1, the condensed feed air in stream 36 is passed through valve 38 and then passed in streams 39 and 40 respectively into higher pressure column 14 and lower pressure column 15. If desired, as shown in FIG. 1 by stream 62, a portion of stream 36 may be recovered as liquid air.

Within cryogenic air separation plant 13 the feed air is separated by cryogenic rectification to produce at least one of product oxygen, product nitrogen and product argon. FIG. 1 illustrates in representative fashion the removal or recovery of product and waste streams from plant 13 in this embodiment of the invention. Product gaseous nitrogen is withdrawn from plant 13 in stream 43, passed through heat exchanger 9, passed to product compressor 60 as stream 44 and recovered in stream 61. Waste nitrogen is withdrawn from plant 13 in stream 41, passed through primary heat exchanger 9, and removed from the system in stream 42. Product gaseous oxygen is withdrawn from plant 13 in stream 48, passed through primary heat exchanger 9 and recovered as stream 49. Product liquid nitrogen is recovered from plant 13 in stream 45. Product liquid oxygen is recovered from plant 13 in stream 46. Product argon is recovered from plant 13 in stream 47. It is understood that in any particular practice of the invention only one of, any two of, or all three of product oxygen, product nitrogen and product argon may be recovered from the cryogenic air separation plant.

Figure 2:
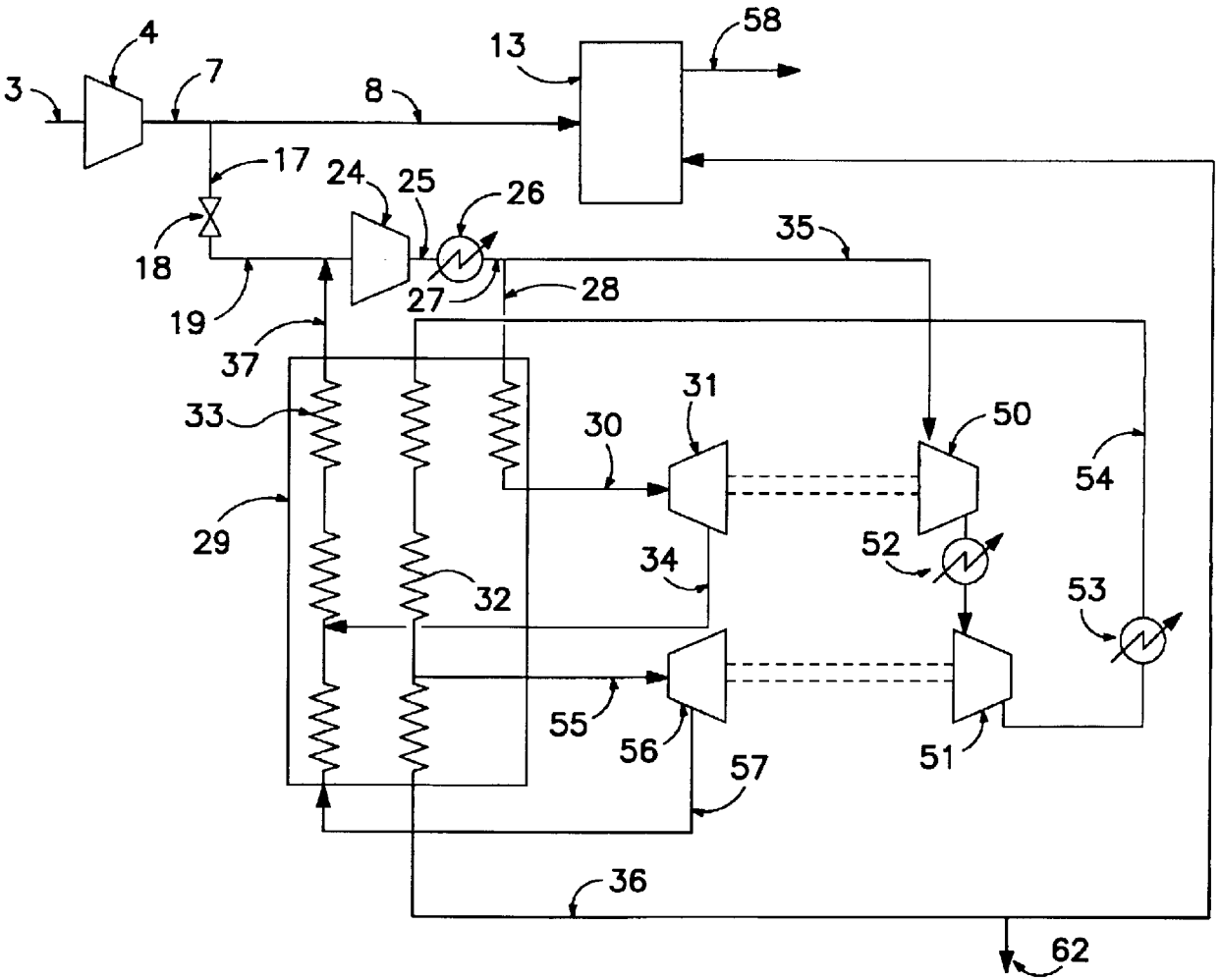
FIG. 2 is a simplified schematic representation of another preferred embodiment of the enhanced liquid capacity cryogenic air separation system of this invention wherein an auxiliary turboexpander is employed.

FIG. 2 illustrates in simplified representative fashion another preferred embodiment of the invention wherein an auxiliary turboexpander is employed. The numerals in FIG.

2 are the same as those of FIG. 1 for the common elements and these common elements will not be described again in detail. In FIG. 2, second part 35 is still further compressed in at least one auxiliary compressor prior to being condensed. In the embodiment of the invention illustrated in FIG. 2, second part 35 is still further compressed in first auxiliary compressor 50 and second auxiliary compressor 51 with cooling downstream of each compressor in coolers 52 and 53 respectively. Resulting still further compressed feed air, having a pressure which may range up to 1400 psia, is passed in stream 54 to cooling pass 32 of heat exchanger or feed air condenser 29. After partial traverse of cooling pass 32, a portion 55 of the feed air passing through cooling pass 32 is passed to auxiliary turboexpander 56 wherein it is expanded to generate additional refrigeration. Resulting turboexpanded feed air stream 57 is passed from auxiliary turboexpander 56 to warming pass 33 wherein with turboexpanded stream 34 from turboexpander 31 it is warmed to cool and condense by indirect heat exchange the feed air traversing cooling pass 32. Resulting condensed feed air 36 is passed to cryogenic air separation plant 13 and one or more products, particularly liquid products, are produced in and recovered from plant 13, as shown in representative fashion by product recovery 58. Preferably, as shown in FIG. 2, turboexpander 31 is coupled to and drives first auxiliary compressor 50, and auxiliary turboexpander 56 is coupled to and drives second auxiliary compressor 51.

Now by the use of this invention one can generate additional refrigeration and provide the additional refrigeration into a cryogenic air separation plant in the form of liquid feed air, thus enhancing the capability or capacity of the cryogenic air separation plant to produce one or more liquid products without engaging the primary heat exchanger or other critical existing features of the cryogenic air separation plant. Moreover, by the use of this invention, refrigeration can be generated by operating the air compressors and the auxiliary liquefier system for startup of the cryogenic air separation plant. Still further, when the cryogenic air separation plant main refrigeration source becomes unavailable due to equipment failure, the auxiliary liquefier can supply needed refrigeration to maintain the cryogenic air separation plant operational.

Although the invention has been described in detail with reference to certain preferred embodiments, those skilled in the art will recognize that these are other embodiments of the invention within the spirit and the scope of the claims.

What is claimed is:

1. A method for carrying out cryogenic air separation comprising:

(A) compressing feed air and passing a first portion of the compressed feed air into a cryogenic air separation plant;

(B) further compressing a second portion of the compressed feed air to produce further compressed feed air, turboexpanding a first part of the further compressed feed air and warming the turboexpanded first part of the further compressed feed air by indirect heat exchange with a second part of the further compressed feed air to condense said second part of the further compressed feed air;

(C) passing the condensed second part of the further compressed feed air into the cryogenic air separation plant; and (D) producing by cryogenic rectification within the cryogenic air separation plant at least one of product oxygen, product nitrogen and product argon.

2. The method of claim 1 wherein the second part of the further compressed feed air is still further compressed prior to being condensed.

3. The method of claim 2 wherein some of the still further compressed second part is turboexpanded and then warmed to provide further cooling for condensing the second part of the further compressed feed air.

4. The method of claim 1 wherein the first part of the further compressed feed air is cooled prior to being turboexpanded.

5. The method of claim 1 wherein the cryogenic air separation plant comprises a higher pressure column and a lower pressure column, and the condensed second part of the further compressed feed air is passed into the higher pressure column and into the lower pressure column.

6. Apparatus for carrying out cryogenic air separation comprising:

(A) a primary compressor, a booster compressor, a cryogenic air separation plant, means for passing feed air to the primary compressor, means for passing feed air from the primary compressor to the cryogenic air separation plant, and means for passing feed air from the primary compressor to the booster compressor;

(B) a turboexpander, a heat exchanger having a cooling pass and a warming pass, means for passing feed air from the booster compressor to the turboexpander and from the turboexpander to the warming pass, and means for passing feed air from the booster compressor to the cooling pass;

(C) means for passing feed air from the cooling pass to the cryogenic air separation plant; and (D) means for recovering at least one of product oxygen, product nitrogen and product argon from the cryogenic air separation plant.

7. The apparatus of claim 6 wherein the means for passing feed air from the booster compressor to the cooling pass includes at least one auxiliary compressor.

8. The apparatus of claim 6 further comprising an auxiliary turboexpander, means for passing feed air from the cooling pass to the auxiliary turboexpander, and means for passing feed air from the auxiliary turboexpander to the warming pass.

9. The apparatus of claim 6 further comprising a recycle compressor, and wherein the means for passing feed air from the primary compressor to the booster compressor includes the recycle compressor.

10. The apparatus of claim 6 wherein the cryogenic air separation plant comprises a higher pressure column and a lower pressure column, and wherein the means for passing feed air from the cooling pass to the cryogenic air separation plant communicates with the higher pressure column and with the lower pressure column.

* * * * *